US006148146A

United States Patent [19]

Poore et al.

[11] Patent Number: 6,148,146

[45] Date of Patent: Nov. 14, 2000

[54] WATER HEATER

[76] Inventors: Bobby L. Poore, 13 Evergreen St., Greenville, S.C. 29609; James B. Loftis, 1000 Tempo Dr., St. Louis, Mo. 63146

[21] Appl. No.: 09/226,485

[22] Filed: Jan. 7, 1999

Related U.S. Application Data

[60] Provisional application No. 60/072,268, Jan. 7, 1998.

[51] Int. Cl.[7] ..... F24H 1/20; H05B 3/78

[52] U.S. Cl. ..... 392/452; 392/473; 122/13.2

[58] Field of Search ..... 122/13.1, 13.2; 126/13 R, 361, 362, 366, 367; 392/452, 473, 491, 498, 487

[56] References Cited

U.S. PATENT DOCUMENTS

| | | | |
|---|---|---|---|
| D. 84,781 | 8/1931 | Hardy . | |
| D. 262,991 | 2/1982 | Owen . | |
| D. 262,992 | 2/1982 | Owen . | |
| D. 351,900 | 10/1994 | Prevot . | |
| D. 356,861 | 3/1995 | Busalt . | |
| 1,138,593 | 5/1915 | Mosteller | 392/473 |
| 1,357,019 | 10/1920 | Alexander et al. . | |
| 4,414,464 | 11/1983 | Cloutier . | |
| 4,489,708 | 12/1984 | Yamamoto et al. | 126/362 |
| 4,514,617 | 4/1985 | Amit | 392/452 |
| 4,551,612 | 11/1985 | Sprague . | |
| 4,632,065 | 12/1986 | Kale | 126/13 R |
| 4,777,347 | 10/1988 | Mottershead | 392/452 |
| 4,869,232 | 9/1989 | Narang | 126/361 |
| 5,206,928 | 4/1993 | Sporri | 392/491 |
| 5,247,908 | 9/1993 | Williamson . | |
| 5,697,330 | 12/1997 | Yetman et al. | 122/13.1 |
| 5,809,941 | 9/1998 | Allaire | 122/13.2 |

*Primary Examiner*—Teresa Walberg
*Assistant Examiner*—Leonid Fastovsky
*Attorney, Agent, or Firm*—Leatherwood Walker Todd & Mann, P.C.

[57] ABSTRACT

A hot water heater of a low profile, box-shaped design, with the height and width remaining generally constant, and the length being dependent on the volumetric capacity desired for the water heater. The water heater is configured for horizontal configuration or vertical mounting and includes a cold water inlet for allowing input of cold water into a lower compartment. A baffle plate divides the lower compartment from an upper compartment, and water from the cold water inlet flows through a baffle opening, or delivery outlet, into the upper compartment. While in the lower compartment, the water is subjected to heating by at least one heating element, which serves to pre-heat the water. As the water flows to the upper compartment, it is heated further by at least one additional heating element located in the upper compartment. A hot water outlet is provided in the upper compartment generally at the opposite end of the upper compartment from the baffle opening such that the water will have passed all of the heating elements prior to exiting the hot water outlet. A gas burner version of the water heater includes a conduit for delivering water through a water chamber such that the water is pre-heated in the conduit prior to exiting a delivery opening.

16 Claims, 3 Drawing Sheets

WATER HEATER

This application claims the benefit of U.S. Provisional Application No. 60/072,268, filed Jan. 7, 1998, and entitled, "Improved Water Heater."

BACKGROUND OF THE INVENTION

This invention relates to a generally rectangularly-shaped gas or electric water heater.

Conventional hot water heaters typically used in residential and commercial applications are cylindrical in shape and are installed upright. In residential applications, the water heater is often installed in a basement, crawl space, garage, attic, etc., or, may be installed in an interior room, closet, utility room, or the like. Cabinet-style hot water heaters are also known which have a box-shaped exterior configuration and which can be placed in the kitchen, laundry room, etc., or other areas within a home.

A limitation arises with conventional cylindrical hot water heaters in that because of their height requirement, installation of such hot water heaters in crawl spaces beneath homes can be problematic. There are certain types of cylindrical hot water heaters known as "low boy" heaters, which are shorter and of larger diameter for installation in crawl spaces, while still providing adequate hot water capacity, but an additional limitation arises in that such styles of hot water heaters cannot be so wide that they will not fit through the standard crawl space access opening, i.e., the width of the hot water heater is limited to the width of the crawl space opening.

Because of the size constraint for such low boy style heaters, if additional hot water heating capacity is desired, for example for use in connection with spas, whirlpool baths, etc., then one or more additional low boy type water heaters will be required. This may also require additional electrical service lines to be run, additional circuit breakers, etc., which can result in additional expense.

A particular problem arises with gas-fired hot water heaters. Because of the venting and height requirements of gas-fired hot water heaters, they typically cannot be used for crawl space applications.

Another problem with conventional cylindrical hot water heaters, both electric and gas-fired, are the space requirements necessitated by their cylindrical shape. As such, they do not lend themselves to being placed into a corner of a structure, and thereby provide for a less than optimal use of space. Finally, cylindrical hot water heaters typically do not generally lend themselves to being installed horizontally, such as above or from the ceiling system, floor joist system, etc.

Various hot water heater designs have been patented. For example, U.S. Pat. No. 4,414,464, issued to Cloutier, discloses a hot water heating device for use with a closed circuit central heating system. The device includes a cylindrical barrel having heating elements and T-shaped nozzles for providing circulation and distribution of liquid about the heating elements. U.S. Pat. No. 4,551,612, issued to Sprague, discloses a hot water heater for placement in the wall, as also does U.S. Pat. No. 5,247,908, issued to Williamson. U.S. Pat. No. 1,357,019, issued to Alexander, et al., discloses a hot water heater having electric heating coils which are used for various heater configurations.

While the foregoing designs are known, there still exists a need for a hot water heater which is of a low profile design having a large hot water volume capacity and which can be disposed horizontally.

SUMMARY OF THE INVENTION

It is, therefore, the principal object of this invention to provide a hot water heater which is of low profile design and which may be disposed horizontally.

Another object of the present invention is to provide a hot water heater which includes a cylindrical hot water heating and storage tank within a box-shaped housing.

An additional object of the present invention is to provide a hot water heater which includes a rectangular hot water heating and storage tank.

A further object of the present invention is to provide a hot water heater having reduced direct mixing of cold inlet water and heated water.

Yet another object of the present invention is to provide a hot water heater for horizontal disposition which is gas-fired.

Still another object of the present invention is to provide a hot water heater sled for transporting a hot water heater constructed in accordance with the present invention.

Generally, the present invention includes a hot water heater of a low profile design. Preferably, the hot water heater is of a box-shaped design, with the height and width remaining generally constant, and the length being dependent on the volumetric capacity desired for the water heater. The water heater is configured for horizontal configuration, but could also be vertically disposed, if desired.

The present invention includes a cold water inlet for allowing input of cold water into a lower compartment. A baffle plate divides the lower compartment from an upper compartment, and water from the cold water inlet flows through a baffle opening into the upper compartment. While in the lower compartment, the water is subjected to heating, preferably by two heating elements, which serve to pre-heat the water.

As the water flows to the upper compartment, it is heated further by additional heating elements located in the upper compartment. A hot water outlet is provided in the upper compartment generally at the opposite end of the upper compartment from the baffle opening such that the water will have passed all of the heating elements prior to exiting the hot water outlet.

The baffle plate, by limiting flow from the lower compartment to the upper compartment through the baffle opening, reduces the direct mixing of the cold inlet water and the heated water adjacent the hot water outlet.

Additionally, thermostats are provided in both the upper and lower compartments of the hot water heater for controlling the energization of the heating elements. Also provided is an anode rod and a pressure relief valve.

Another version of the present invention is provided with gas burners, instead of electrical heating elements. In such an embodiment, an elongated gas burner is provided beneath the lower water compartment, and the heated water moves through an inlet pipe into a heating chamber. The gas-fired version of the present invention would also be horizontally disposed.

Because of the box shape of the present invention, multiple units of the present invention may be stacked on top of one another or aligned side by side, thereby minimizing space requirements. Further, because of its rectangular configuration, the hot water heater of the present invention, can be placed in a corner portion of a room, for optimizing space utilization, or could be mounted to floor joists beneath the floor, or above or below the ceiling, if desired.

A further aspect of the present invention is the provision of a sled for transporting a hot water heater constructed in accordance with the present invention. The sled includes a handle which will allow an installer to simply drag the sled and the hot water heater on the ground into place within a crawl space, basement, etc.

Further provided is a drain tray for placement beneath the present hot water heater where installation is made in the attic or some other interior location. The purpose of the drain tray is to catch run-off in the event of a rupture of the hot water heater or some other related plumbing failure.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
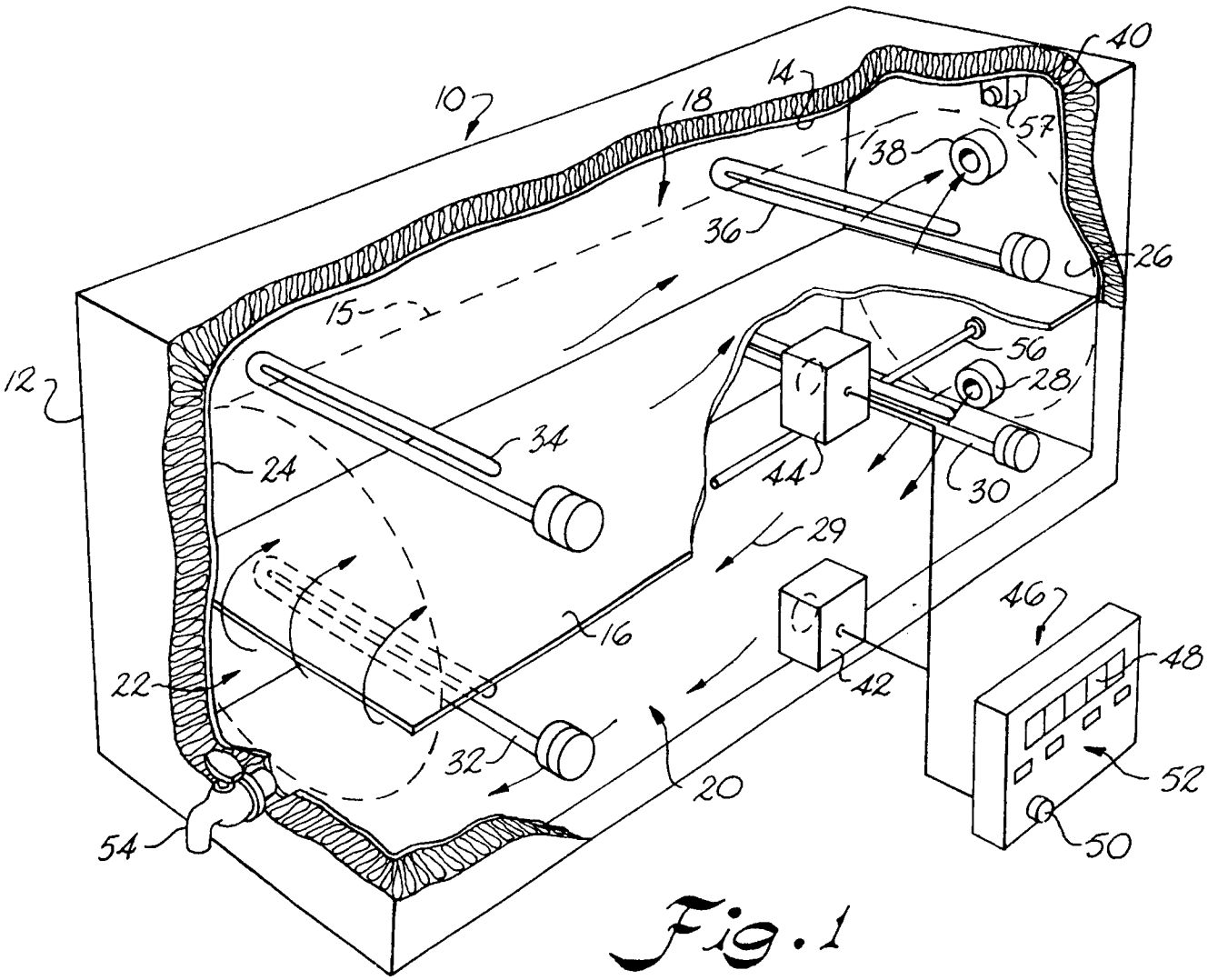
FIG. 1 is a perspective view, with parts cut away, of an electric hot water heater constructed in accordance with the present invention.

The accompanying drawings and the description which follows set forth this invention in its preferred embodiment. However, it is contemplated that persons generally familiar with water heaters will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the water heater of the present invention is indicated generally in the figures by reference character 10.

Turning to FIG. 1 of the drawings, an electric hot water heater constructed in accordance with the present invention is shown. As can be seen, the exterior of hot water heater 10 is generally rectangular in shape and includes a housing 12 having disposed therein a water heating chamber, generally 14. Water heater chamber 14 is preferably constructed of plastic to facilitate the construction of chamber 14 by molding, and is preferably cylindrically-shaped, as shown in phantom as chamber 15, but could also be generally rectangular, or, box-shaped. Chamber 14 could be constructed of metal, ceramic, or glass-coated metal materials, if desired.

While the Figures hereof are drawn primarily to a chamber 14 of a generally boxed-shape, it is to be understood that the features of the present invention find equal applicability with the cylindrically-shaped chamber 15, and the present invention is to be construed as specifically including use of the chamber 15 as a preferred embodiment.

Water heater chamber 14 is divided by baffle plate 16 into an upper compartment 18 and a lower compartment 20. Upper and lower compartments 18, 20 are in fluid communication with one another by way of baffle opening 22 located at one end of chamber 14. Baffle opening 22 is created, generally, by shortening baffle plate 16, such that it does not extend all the way to the end 24 of chamber 14. Baffle plate 16 is connected to end 26 of chamber 14, which is opposite end 24.

A cold water inlet 28 is provided for delivering cold water to heater 10. Heater 10 is connected to the cold water supply lines of the home or other structure in a conventional manner as would be known hot water heaters. As shown by arrows 29, cold water enters lower chamber 20 and is initially subjected to electric heating elements 30, 32, where the water picks up heat. During initial use, as the water level in lower compartment 20 rises, water therein has been preheated to an extent, such that when the water level reaches baffle opening 20, the water from lower compartment 20 begins to fill upper compartment 18. At this point, the thus preheated water is further heated by electric heating elements 34, 36, which are disposed within upper compartment 18. It is to be understood that during normal operation, water heater chamber 14 is generally filled with water, but as heated water exits hot water outlet 38, cold water will enter cold water inlet 28 and will follow the same general path as discussed above, i.e., being preheated in lower compartment 20 prior to entering upper compartment 18.

An advantage of the hot water heater 10 is that by forcing the water to flow through lower compartment 20, and past elements 30, 32, 34, 36 prior to exiting hot water outlet 38, the water in upper compartment 18 adjacent hot water outlet 38 should generally be the highest temperature water within water heater chamber 14. This is significant because when a hot water demand is placed on water heater 10, the hottest water is drawn immediately through hot water outlet 38, which can increase the speed at which hot water reaches the tap, washing machine, dishwasher, etc., and which can also reduce the amount of cold water wasted at the tap, or otherwise, while waiting for hot water to arrive.

Baffle plate 16 can be attached within water heater chamber 14 by conventional fastening means, such as adhesives, bolts, screws, or other fastening means, and could be constructed of metal, plastic, or some other suitable material.

Housing 12 could be of sheet metal construction, or alternately, could also be of molded plastic, if desired. Insulation 40 is preferably provided in the space between water heater chamber 14 and housing 12 in order to reduce heat loss from chamber 14.

Preferably, water heater 10 includes two thermostats, 42, 44. Thermostat 42 senses the temperature of water within lower compartment 20, and thermostat 44 senses the temperature of water in upper compartment 18.

Thermostats 42, 44 are preferably connected to a remote control and display box, generally 46. Box 46 is preferably disposed within the home or other structure, in a similar fashion as is a heating, ventilation and cooling thermostat, to allow the user to detect the temperature of water in water heater 10, and also to adjust the temperature accordingly. Box 46 can be further used to disable the hot water heater during periods of nonuse, such as during the night, or to raise the water temperature at predetermined times to handle periods of high demand for heated water.

Preferably box 46 includes a digital or analog display 48, which can be used to display actual water temperature, desired water temperature, clock functions, timing intervals for disabling or energizing water heater 10, etc. Adjustment knob, generally 50, or buttons, generally 52, can be provided for making the above adjustments. Further, box 46 can include an alarm feature in the event water heater 10 is disabled or has exceeded a desired temperature, which could indicate malfunctioning of a thermostat 42, 44. Moreover, box 46, which preferably includes a microcomputer, programmable logic controller, or the like, could be used to determine heating efficiency of hot water 10 by comparing water temperature with the energy load of the heating elements 30, 32, 34, 36. This could give an indication of a faulting heating element, buildup of scale in water chamber 14, or some other problem.

A drain valve 54 is connected to chamber 14 to allow for periodic draining of chamber 14 and/or for servicing water heater 10. Also, disposed within chamber 14 is a conventional anode rod 56. Relief valve 57 prevents the excess buildup of pressure in chamber 14.

The cross sectional dimension of elongated water heater 10 could vary between a wide variety of dimensions, but is preferably approximately 17 inches high, and 17 inches wide. The length of heater 10, and accordingly, of chamber 14, could vary greatly, depending on the hot water heating capacity desired. With the above stated dimensions, water heater 10 is of a low enough profile to allow it to be easily pulled through crawl space openings, attic openings, etc. Further, because the capacity of heater 10 depends on its length, a water heater with a much larger capacity than can be found in single "low boy" type water heater is anticipated by the present invention.

Because of the box shape of the heater 10, it can be readily bolted to floor joists beneath the floor in a crawl space, and thus maintained out of contact with the soil beneath the house. This can contribute to the life of water heater 10, in that the opportunities for rust, corrosion, etc. invading housing 12 and the electrical service are reduced by removing the heater from contact with the ground.

The rectangular shape of heater 10 also allows for stacking of multiple units of heater 10, if desired, in a manner which optimizes both stability and use of space. Because of its rectangular shape, heater 10 can be inserted in the corner portion of a room, garage, or the like, taking no more space than necessary.

Figure 2:
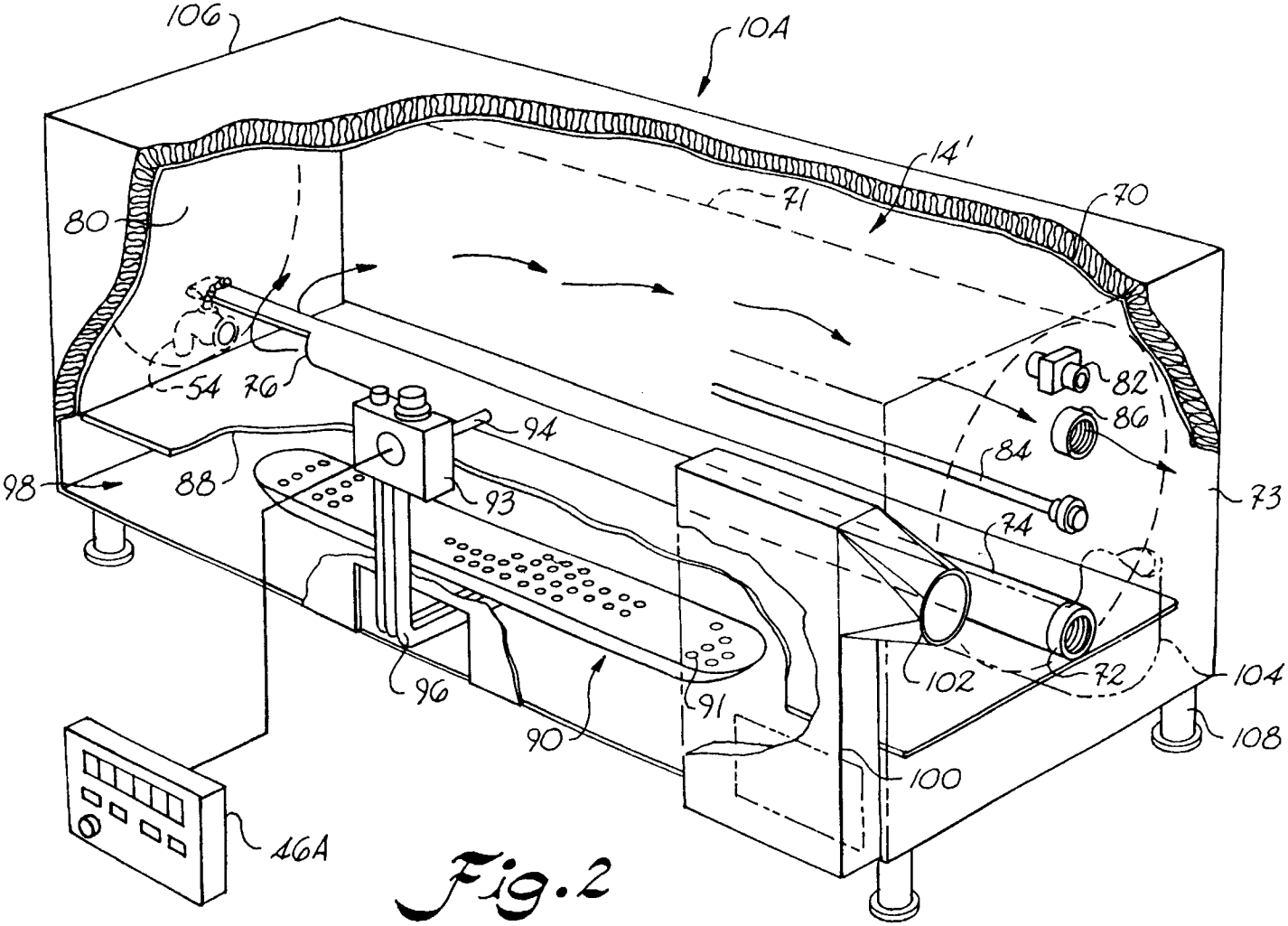
FIG. 2 is a perspective view, with parts cut away, of a gas fired water heater constructed in accordance with the present invention.

Turning now to FIG. 2, an alternate embodiment of the present invention, hot water heater 10A, is illustrated. Hot water heater 10A is a gas fired variation of hot water heater 10 and includes a water heater chamber 70 for heating water. Chamber 14' is preferably a cylindrical chamber 71, but could also be rectangular, if desired. While the Figures hereof are drawn primarily to a box-shaped chamber 70, it is to be understood that the features of the present invention find equal applicability with cylindrically-shaped chamber 71, and the present invention is to be construed as specifically including use of the chamber 71 as a preferred embodiment.

A cold water inlet 72 is provided at one end 73 of chamber 70, and a drain 54 is provided at the opposite end thereof. An inlet pipe 74 is connected to cold water inlet 72 and carries cold water substantially the length of water heater chamber 70 before the water exits discharge passage 76 of inlet pipe 74. Preferably, inlet pipe 74 is suspended within chamber 70 along its length such that once water chamber 70 is initially filled and in operation, cold water coming from inlet 72 will be preheated within inlet pipe 74 as it passes therethrough to discharge opening 76. Inlet pipe 74 is shown welded at its end 78 opposite inlet 72 to an end wall 80 of chamber 70. It is to be understood, however, that end 78 of inlet pipe 72 could be attached to wall 80 through any suitable fastening means.

Chamber 14' is preferably constructed of metal having a ceramic, glass, or other suitable coating. A relief vent 82 is provided at an upper end of chamber 70, and an anode rod 84 is also provided within chamber 70.

Water flowing from discharge opening 76 serves to fill chamber 70, and as chamber 70 is initially filled and thereafter, the water flows outwardly through hot water outlet 86, once a downstream demand for hot water is placed on heater 10A. Chamber 70 includes a bottom plate 88 which is subjected to heating by a gas burner, generally 90. Gas burner 90 includes flame openings 91 for emitting flames for heating bottom plate 88, and accordingly, the water therein. A thermostat 92 is provided having a probe 94 within chamber 70 for sensing water temperature. Thermostat 92 controls cycling of burner 90 and also includes a gas valve for allowing the inflow of gas through supply lines 96.

Burner 90 is carried within a burner chamber 98, and exhaust from chamber 98 passes through an exhaust manifold 100 and outwardly through an exhaust vent 102 and vent pipe 104.

Connected to thermostat 92 is a remote control and temperature display box 46A which operates in similar fashion as does box 46 discussed above, except within the context of controlling the flow of gas to the heating element. It is to be understood that electrical service is also provided to thermostat 92 for controlling operation of thermost at 92.

Water heater 10A includes a housing 106 to which legs 108 are attached for supporting housing 106 above ground.

Water heater 10A, because of its low profile design, can be used for crawl space applications where conventional gas fired hot water heaters of upright, cylindrical configuration, cannot typically be used due to height limitations within the crawl space. The exterior dimensions of heater 10A could be the same or similar to that of water heater 10, discussed above, and are preferably approximately 21 inches high, and 17 inches wide. The length of heater 10A could vary greatly, depending on the hot water heating capacity desired. With the above stated dimensions, water heater 10A is of a low enough profile to allow it to be easily pulled through crawl space openings, attic openings, etc.

Figure 3:
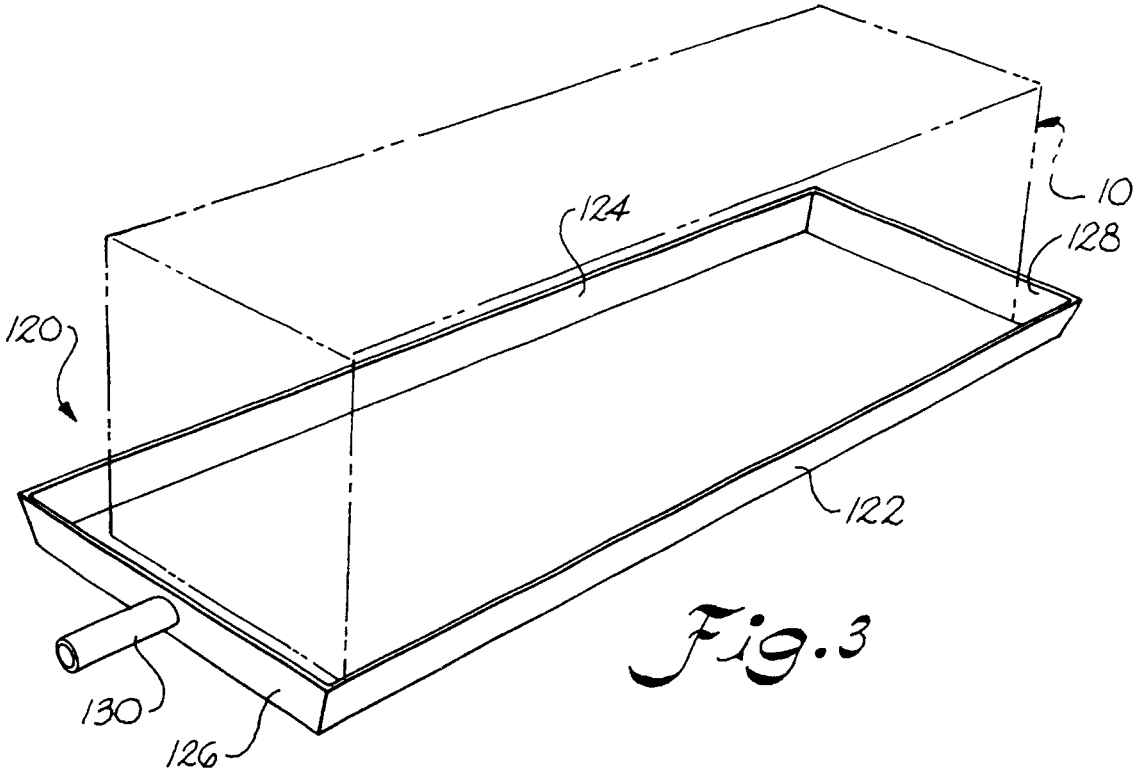
FIG. 3 is a perspective view of a drainage pan constructed in accordance with the present invention.

FIG. 3 illustrates a generally rectangular drain pain 120 for use beneath either of heaters 10 or 10A. Pan 120 includes sidewalls 122, 124, and end walls 126 and 128. Disposed in one end of pan 120 is a drain opening 130 for carrying away water in the event of a leak or rupture of heater 10 or 10A, or from the water supply and delivery connections thereto.

Figure 4:
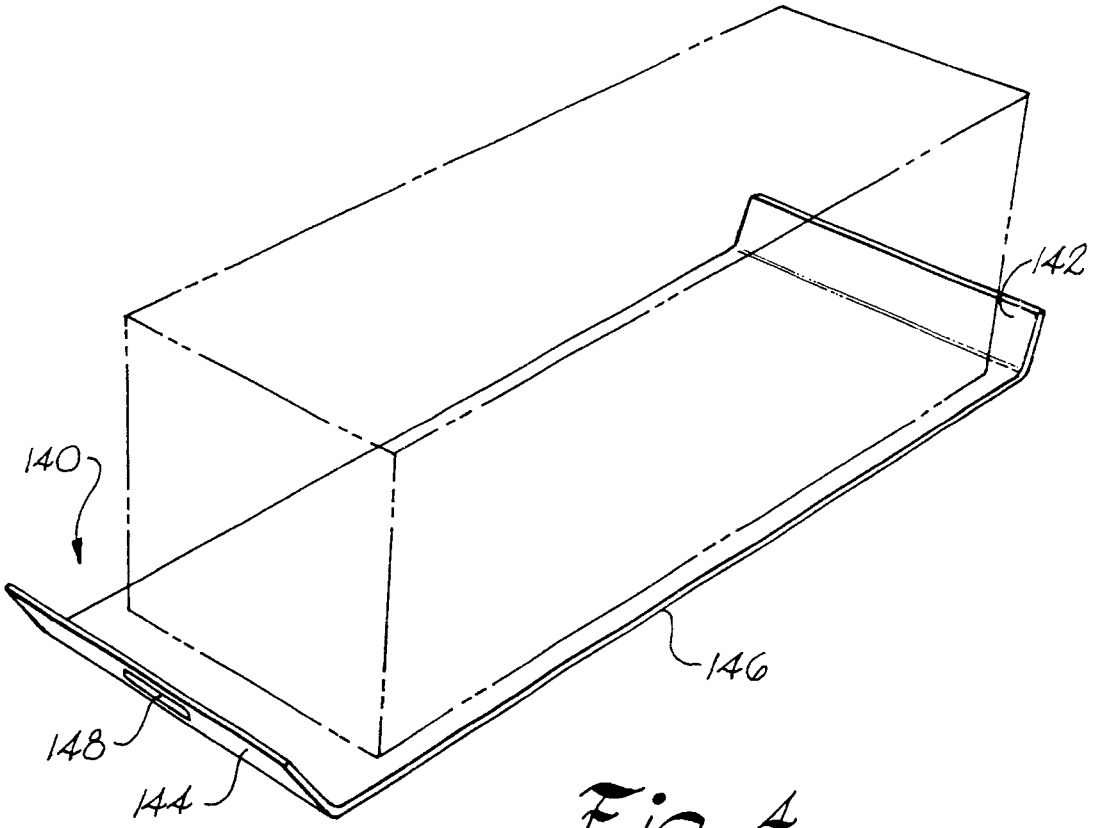
FIG. 4 is a perspective view of a sled for transporting a water heater constructed in accordance with the present invention.

FIG. 4 illustrates a drag sled 140 for use in transporting a water heater constructed in accordance with the present invention. The water heater would simply be placed on sled 140, and sled 140 could then be dragged along the ground, for example, beneath a home in the crawl space, to the proper point of installation. An upturned end 142 is provided, as well as an upturned front portion 144 for maintaining the water heater on sled 140. Base portion 146 of sled 140 is preferably of a relatively smooth configuration to facilitate dragging of sled 140. A handle 148 is provided in upturned portion 144 to allow sled 140 to be grasped by the installer for pulling the water heater into position. Additional embodiments of the present invention are shown and described in a document attached as Exhibit A (entitled, "Low-Bob Horizontal Water Heater") to our U.S. Provisional Application No. 60/072,268, filed Jan. 7, 1998, the entirety of which (including Exhibit A) is incorporated herein by reference thereto.

From the foregoing, it can be seen that the water heater designs of the present invention produce low profile box shaped devices which lend themselves to installation in applications where space limitations are a problem, such as crawl spaces, attic spaces, closet spaces, etc. Further, because of their design, they can be made in differing lengths to accommodate a variety of hot water capacity demands.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the teachings of the foregoing disclosure.

What is claimed is:

1. A water heater for horizontal mounting, comprising:

an elongated, horizontally disposed water chamber having a top portion, a bottom portion generally opposite said top portion, a first end portion, and a second end portion generally opposite said first end portion;

a longitudinally extending baffle plate in said water chamber; said baffle plate being connected to said first end portion of said water chamber and extending generally horizontally in said water chamber; said baffle plate defining an upper compartment and a lower compartment in said water chamber and a baffle opening proximate to said second end portion of said water chamber;

a water inlet connected to said lower compartment and configured for receiving water and introducing same into said lower compartment;

at least one heater associated with said lower compartment for heating water introduced into said lower compartment through said water inlet; and a water outlet connected to said upper compartment configured for allowing water heated in said lower compartment to exit said upper compartment after passing through said upper and lower compartments and said baffle opening.

2. A water heater as defined in claim 1, wherein said water chamber has a generally rectangular cross-section.

3. A water heater as defined in claim 1, wherein said water chamber is generally cylindrical.

4. A water heater as defined in claim 1, further comprising an elongated housing having a generally square cross-section, said water chamber being carried in said housing.

5. A water heater as defined in claim 1, wherein said at least one heater includes two heaters in said lower compartment.

6. A water heater as defined in claim 1, further comprising at least one upper compartment heater associated with said upper compartment for heating water introduced into said upper compartment.

7. A water heater as defined in claim 6, wherein said at least one upper compartment heater includes two heaters in said upper compartment.

8. A water heater as defined in claim 1, further comprising a thermostat connected to said lower compartment for detecting the temperature of water in said lower compartment.

9. A water heater as defined in claim 1, further comprising a thermostat connected to said upper compartment for detecting the temperature of water in said upper compartment.

10. A water heater as defined in claim 1, further comprising an elongated housing and said water chamber being carried in said housing.

11. A water heater as defined in claim 10, wherein said housing is generally rectangular in cross-section.

12. A water heater as defined in claim 10, further comprising insulation disposed between said water chamber and said housing.

13. A water heater as defined in claim 1, further comprising a remote thermostat control connected to said water chamber having a temperature display for displaying the actual temperature of water in the water chamber; said remote thermostat control being configured for mounting at a location separate and remote from said water heater.

14. A water heater as defined in claim 13, wherein said remote thermostat control has means for selectively adjusting the desired water temperature for water in said water chamber.

15. A water heater as defined in claim 1, wherein said at least one heater is electrically energizable.

16. A method of heating water, comprising:

providing an elongated, generally rectangular, horizontally disposed water chamber having a top portion, a bottom portion generally opposite said top portion, a first end portion, and a second end portion generally opposite said first end portion;

providing a longitudinally extending baffle plate in said water chamber connected to said first end portion of said water chamber and extending generally horizontally in said water chamber, such that said baffle plate defines an upper compartment and a lower compartment in said water chamber and a baffle opening proximate to said second end portion of said water chamber;

providing a water inlet in said first end portion of said water chamber connected to said lower compartment;

providing a water outlet in said first end portion of said water chamber connected to said upper compartment;

introducing water into said lower compartment through said water inlet until said lower compartment is filled and said water passes through said baffle opening and reaches said water outlet;

providing at least one heater in said lower compartment for heating water introduced into said lower compartment through said water inlet;

heating the water in said lower compartment; and withdrawing from said water outlet the water heated in said lower compartment.

* * * * *